US005154072A

United States Patent [19]

Leyden

[11] Patent Number: 5,154,072

[45] Date of Patent: Oct. 13, 1992

[54] CABLE LOCK FOR SECURING GARMENTS AGAINST THEFT

[75] Inventor: Roger J. Leyden, Willow Springs, Ill.

[73] Assignee: Se-Kure Control, Inc., Chicago, Ill.

[21] Appl. No.: 676,825

[22] Filed: Mar. 28, 1991

[51] Int. Cl.[5] ..... E05B 69/00

[52] U.S. Cl. ..... 70/18; 70/59; 211/4

[58] Field of Search ..... 70/30, 49, 58, 62, 59, 70/18; 211/4, 7

[56] References Cited

U.S. PATENT DOCUMENTS

| | | | |
|---|---|---|---|
| 1,221,584 | 4/1917 | Patrick | 211/8 |
| 2,074,759 | 3/1937 | Richards | 292/213 |
| 3,131,985 | 5/1964 | Blonder | 70/57 |
| 3,211,408 | 10/1965 | Schaeffer | 248/553 |
| 4,069,919 | 1/1978 | Fernbaugh | 70/62 |
| 4,204,601 | 5/1980 | Thomas | 70/58 |
| 4,212,175 | 7/1980 | Zakow | 70/58 |
| 4,260,063 | 4/1981 | Bennett et al. | 70/59 |
| 4,336,885 | 6/1982 | Thomas | 70/59 |
| 4,460,093 | 7/1984 | Otema | 70/59 |
| 4,462,317 | 7/1984 | Franko et al. | 109/45 |
| 4,540,092 | 9/1985 | De Santis | 70/62 |
| 4,573,584 | 3/1986 | Otema | 70/59 |
| 4,598,827 | 7/1986 | Keifer | 70/59 |
| 4,640,420 | 2/1987 | McKay | 70/59 |

*Primary Examiner*—Renee S. Luebke
*Assistant Examiner*—D. Boucher
*Attorney, Agent, or Firm*—Wood, Phillips, VanSanten, Hoffman & Ertel

[57] ABSTRACT

A cable lock for securing a cable having a shoulder thereon is provided having a housing and at least one opening in the housing, the opening being dimensioned to receive the cable shoulder therethrough. A cover is mounted for selective movement relative to the housing between a position permitting passage of the cable through the opening to a position preventing passage of the cable through the opening. A tumbler having a movable shaft operatively associated therewith, the shafting being movable independent of the cover is operatively associated with the cover for providing the selective movement of the cover.

15 Claims, 2 Drawing Sheets

CABLE LOCK FOR SECURING GARMENTS AGAINST THEFT

BACKGROUND OF THE INVENTION

1. Technical Field

The present invention is directed toward devices for preventing the theft of garments and more particularly toward a cable lock system permitting the examination and wearing of garments yet securing the garments against theft.

2. Background Art

Clothing retailers in recent years have been overwhelmed with an increase in shoplifting of valuable garments such as fine woolen coats and furs. At the same time, these retailers have been facing increasing labor costs making it more expensive to provide personnel to protect against such theft. To serve the security needs of such retailers, a variety of systems have been devised for protecting garments against theft.

One such system involves fastening an indicator to each garment to be protected. Sensors are provided near the store exits for detecting indicators passing through the sensors. Customers who try to leave the store with a garment that has not had the indicator removed will trip the sensor and trigger an alarm.

Such systems have numerous problems. First, the indicators and sensors are expensive. Second, security personnel are required to monitor the exits near the sensors. Finally, the system may be frustrated by sophisticated shoplifters who are able to remove an indicator from a garment before leaving the store.

Another system for preventing the theft of garments involves attaching one end of a cable to a garment and securing the other end of the cable in a cable lock. A first known cable lock has a rectangular housing with a removable cover. A plurality of open ended slots are provided in opposing walls of the housing. Upon placing the cover on the housing the open end of the slots are blocked. A plurality of cables having an enlarged shoulder portion may be inserted into the slots when the cover is removed and the cables may be secured within the housing by replacing the cover. A conventional key tumbler with an associated shaft is provided for securing the cover upon the housing. A bracket is also typically provided for securing the housing to a fixture such as a clothes rack.

A second known cable disclosed in U.S. Pat. No. 4,460,093 has a rectangular housing with a pair of elongate slots in opposing walls. The elongate slots have an enlarged portion of a size sufficient to permit lengthwise insertion of the cable therein. A tumbler having a retractable or pivotal shaft is oriented on the housing such that, in a locked position, the shaft blocks the enlarged portions and thereby prevents insertion or removal of cables from the housing. In a modification of this structure illustrated in FIG. 7, the slot comprises a central slot having an enlarged portion at its top with a plurality of downwardly extending leg-like slots extending from the central slot.

These prior art cable locks have several advantages over the indicator/sensor system. First, they are less expensive to manufacture and for retailers to use. Second, they do not require personnel to monitor the store exits. Finally, the systems allows customers to try on the garments while keeping the garments on the store floor, making it more difficult for would-be thieves to disconnect the locking devices without being detected by other customers or store personnel.

Notwithstanding these advantages over indicator/-sensor systems, present cable lock systems have significant problems. Addressing the first known cable lock, in order to remove a cable from the housing the cover must be removed from the housing. Removal of the cover can be difficult, and once the cover is removed the cover may be lost, rendering the cable lock system useless. Also, once the housing is removed all of the cables secured therein may be immediately removed simply by sliding the cables out of the slots. Therefore, if a shoplifter is able to remove the cover from the housing he may quickly remove all the cables from the housing and perhaps depart from the store before being detected by sales personnel.

Replacement of the cover is also an awkward operation requiring the individual to hold all of the cables in place with one hand while attaching the cover with the other hand. If the cover is not properly seated, it cannot be locked in place.

Addressing the second known cable lock of the '093 patent, selected cables are difficult to align with the enlarged portion for removal because the slots are designed to hold many cables.

The present invention is directed towards overcoming one or more of the problems discussed above.

SUMMARY OF THE INVENTION

A cable lock for securing a cable having a shoulder thereon therein is provided having a housing and at least one opening in the housing, the opening being dimensioned to receive the cable and shoulder therethrough. A cover is mounted for selective movement relative to the housing between a position permitting passage of the cable through the opening to a position preventing passage of the cable through the opening. A tumbler having a movable shaft operatively associated therewith the shaft being movable independent of the cover is operatively associated with the cover for providing selective movement of the cover.

The cable lock may be used in combination with a cable having a blocking shoulder of a size larger than the cable. The opening may be a slot having an enlarged portion of a size sufficient for receiving the blocking shoulder. A plurality of slots may be provided. The cover can be removable from the plate.

The cable lock of the present invention provides a cable lock housing and a cover where the cover does not have to be removed from the housing in order to insert or remove cables from the housing slots. Thus, the present invention substantially reduces the likelihood of the cover being lost, rendering the cable lock system useless. In addition, the cable lock of the present invention requires that cables be inserted or removed from a slot one at a time. Thus, the risk that a shoplifter will be able to remove the housing cover and quickly dislodge the cables secured in the housing to steal the garments attached to the cables before being detected by store personnel is reduced. Moreover, the cable lock provides a plurality of slots holding a limited number of cables, all of which may be easily accessed when the cover permits passage of the cables through the enlarged portion. Lastly, the cable lock system of the present invention provides these advantages, yet is no more difficult or expensive to build than prior art structures.

Other objects, advantages and features of the present invention will become more apparent from a consideration of the following specification taken in conjunction with the accompanying drawings.

DETAILED DESCRIPTION OF THE PREFERRED EMBODIMENT

Figure 1:
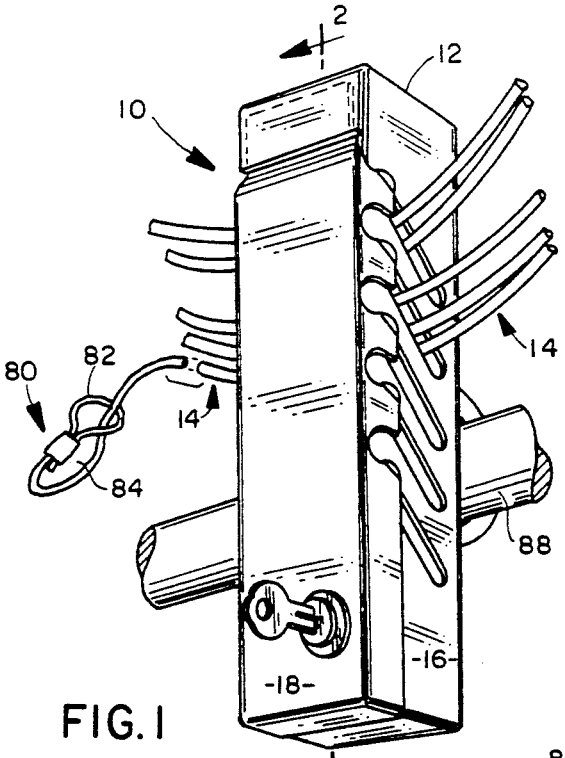
FIG. 1 is a perspective view of the cable lock system of the invention.

The cable lock system 10 of the present invention includes a cable lock 12 for securing a plurality of cables 14.

The cable lock 12 has a housing 16 and a cover 18. In the preferred embodiment, when the housing 16 and the cover 18 are in their assembled relationship they form a cable lock 12 of a rectangular box-like configuration. However, the cable lock 12 may be of any number of geometric configurations.

Figure 5:
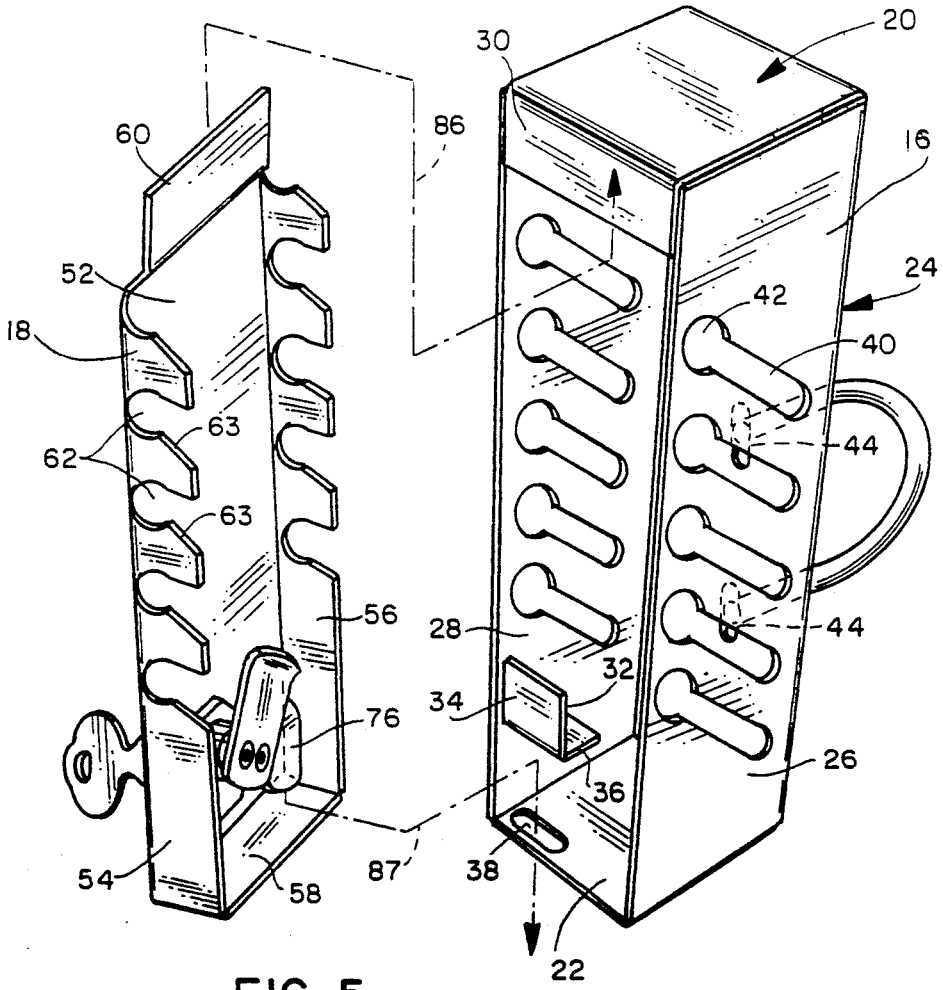
FIG. 5 is a perspective view of the cable lock system of the present invention illustrating the cover removed from the housing and how the cover can be replaced within the housing.

As most clearly illustrated in FIG. 5, the housing 16 has a top housing wall 20, a bottom housing wall 22, a back housing wall 24 and opposed housing side walls or plates 26, 28. A receiving flange 30 descends a short distance from the top housing wall 20 and spans between the opposed housing side walls 26, 28. The front of the housing 16 is open.

A stop 32 having an L-shaped cross-section is attached to the second opposed housing side wall 28 near the bottom housing wall 22 of the housing 16. The L-shaped stop 32 is positioned with an upright portion 34 parallel to the back housing wall 24 and a lower portion 36 parallel to the bottom housing wall 22 and pointed towards the back housing wall 24. A receiving slit 38 is in the bottom housing wall 22 away from the back wall 24.

Both the first and second opposed housing side walls 26, 28 have a plurality of openings or slots 40 therein. The slots 40 have an enlarged portion 42 at one end. The plurality of slots 40 are aligned within the first and second opposed housing side walls 26, 28 such that the enlarged portion 42 is proximate the front of the opposed housing side walls 26, 28 and the slots 40 are angularly inclined to descend from the enlarged portion 42 as the slot extends towards the back housing wall 24. As is best seen in FIGS. 2, 3 and 5, the plurality of slots 40 are aligned in a parallel spaced relationship.

The back housing wall 24 of the housing 16 has a pair of elongated holes 44. A U-bolt 46 is insertable within the elongated holes 44. As seen in FIGS. 2 and 3, the ends 48 of the U-bolt 46 are threaded for threadably receiving nuts 50.

The cover 18 has a face 52 of a width slightly greater than that of the open front of the housing 16. The cover 18 has first and second opposed cover side walls 54, 56 and a cover bottom wall 58. At the top of the face 52 is a securing tongue 60 recessed slightly from the face 52 and of a width sightly less than the width of the receiving flange 30. A plurality of grooves 62 are formed in the first and second opposed cover walls 54, 56. The grooves have an angled cut 64 along their lower portion.

Figure 2:
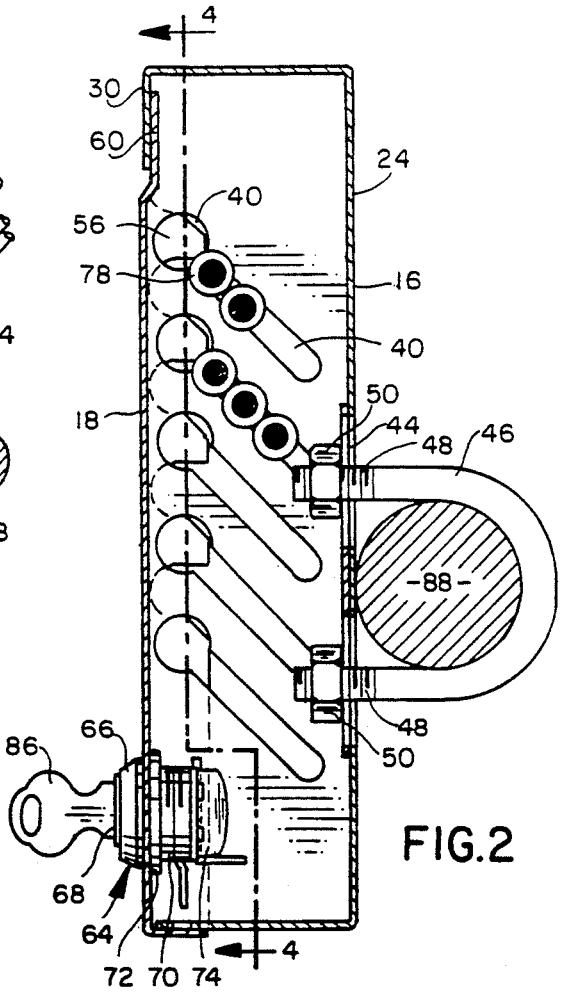
FIG. 2 is a sectional side view of the cable lock system of the present invention taken along line 2—2 of FIG. 1 with the cover in a locked position preventing a cable from being inserted into or withdrawn from the slots.
Figure 3:
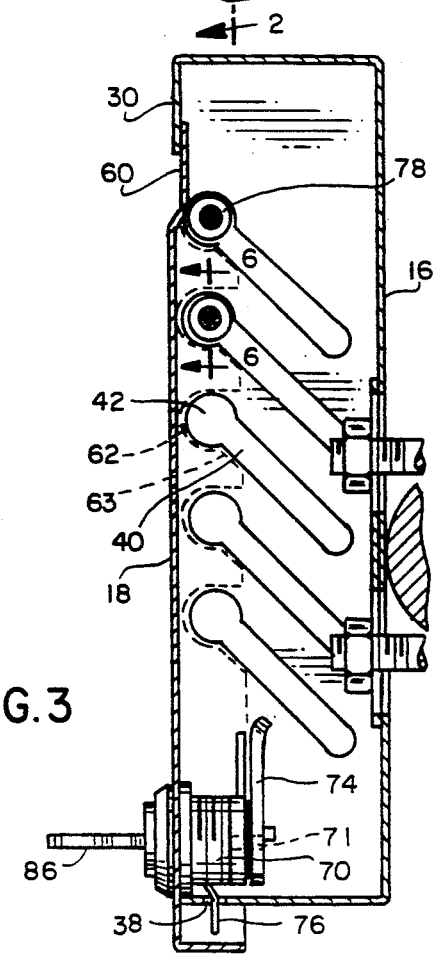
FIG. 3 is identical to FIG. 2 only the cover is shown in a locked position permitting cables to be inserted into or withdrawn from the slots.

As seen in FIG. 2, a tubular key lock 64 is located at the bottom of the face 52 of the cover 18. An annular flange 66 extends from the face 52 of the cover 18 and encircles a tumbler 68. A threaded casing 70 extends opposite the annual flange 66 between the first and second opposed cover side walls 54, 56. A movable shaft 71 is operatively associated with the tumbler 68 and is encased by the threaded casing 70. A nut 72 threadably engages the threaded casing 70 securing the tubular key lock 64 in place relative to the cover 18. As best seen in FIG. 5, a latch or bolt 74 is operatively associated with tubular key lock 64. The threaded key lock 64 and the latch 74 are positioned on the face 52 of the cover 18 such that when the cover 18 engages the housing 16 the bolt may act cooperatively with the L-shaped stop 32 to hold the cover 18 in place relative to the housing 16.

A securing hook 76 is attached to the face 52 of the cover 18 between the first and second opposed cover side walls 54, 56. The securing hook 76 is positioned on the face 52 of the cover 18 such that when the cover 18 engages the housing 16 the securing hook 76 is aligned with the receiving slit 38.

Figure 6:
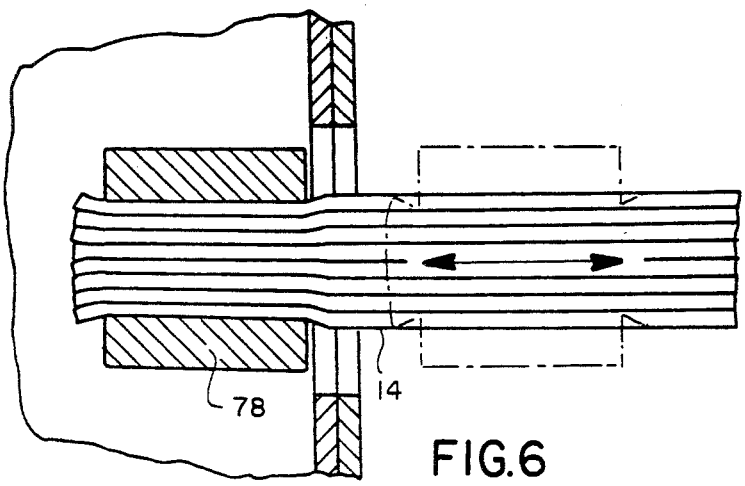
FIG. 6 is a sectional view illustrating the enlarged shoulder portion of a cable in accordance with the cable lock system of the present, invention taken along line 6—6 of FIG. 3.
Figure 7:
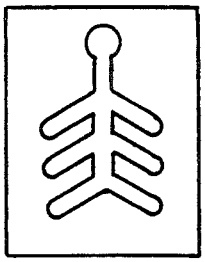
FIG. 7 (PRIOR ART)
FIG. 7 is a side view or a prior art cable lock.

As best seen in FIG. 2, 3 and 6, each of the plurality of cables 14 has a blocking shoulder 78 at one end thereof. At the other end of each of the plurality of cables 14 is a structure 80 for securing a garment. As seen in FIG. 1, the structure 80 for securing a garment may, for example, be a cable loop 82 through which the end of the cable 14 having the blocking shoulder 78 is passed to form a securing loop 84 which may, for example, be used to engage a button hole of a garment.

Assembly of the cover 18 and housing 16 into the cable lock 12 of the present invention is best understood with reference to FIG. 5. The securing tongue 60 is first slid under the receiving flange 30 with the first and second opposed cover side walls 54, 56 disposed outside of the first and second opposed housing side walls 26, 28. This insertion is illustrated by the arrow 86. The face 52 of the cover 18 is then pressed flush against the front of the first and second opposed housing walls 26, 28. The cover 18 is then slid downward relatively to the housing 16 causing the securing hook 76 to be inserted into the receiving slit 38. This insertion is illustrated by arrow 87. The cover 18 engaging the housing 16 as illustrated in FIG. 3 will hereinafter be called the unlocked position.

As can be seen in FIG. 3, when the cable lock 12 is in the unlocked position the bottom of the threaded casing 70 rests against the bottom housing wall 22 The cover 18 is held in place by the securing hook 76 disposed within the receiving slit 78 and the securing tongue 60 which is tucked behind the receiving flange 30. In this position, the grooves 62 are aligned with the enlarged portion 42 of the slots 40. The angled portion 63 can be see in FIG. 3 to be configured such that the entire width of the slot 40 is uninhibited by the first and second opposed cover side walls 54, 56.

As illustrated in FIG. 6 when the cover 18 and the housing 16 are in the unlocked position illustrated in FIG. 3, the blocking shoulder 78 of a cable 14 may be inserted into the enlarged portion 42 of a slot 40. Upon insertion into the enlarged portion 42 of the slot 40, the cable 14 is caused by the action of gravity to fall towards the far end of the slot 40.

Figure 4:
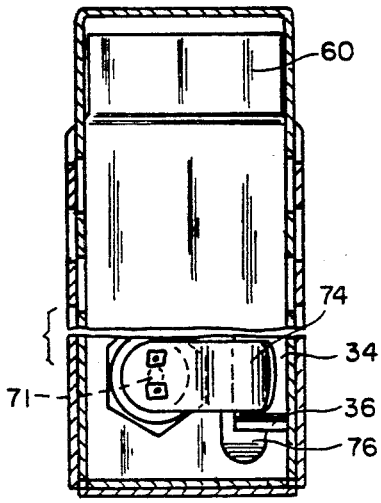
FIG. 4 is a sectional front view of the cable lock system of the present invention taken along line 4—4 of FIG. 2.

The cover 18 can be changed from the unlocked configuration of FIG. 3 to the locked configuration illustrated in FIG. 2 by turning the key 86 in the tubular key lock 64. Upon turning the key 86 when the cover 18 and housing 16 are in the unlocked position of FIG. 3, the movable shaft 71 rotates causing the latch 74 to engage the upright portion of the L-shaped stop 32. As the key is continued to be turned the latch 74 strikes the lower portion 36 of the L-shaped stop 32 and thereby causes the cover 16 to slide upwardly relatively to the housing 18. When the key 86 is fully turned, the cable lock 12 will be in its locked position illustrated in FIG. 2. As can be best seen with reference to FIG. 4, when the cable lock 12 is in its locked position the securing tongue 60 of the cover 18 is almost fully behind the receiving flange 30. In addition, the securing hook 76 becomes fully withdrawn from the receiving slit 38. The cover cannot be removed, however, because the latch 74 engages the upright portion 34 the L-shaped stop 32 and rests upon the lower portion 36 of the L-shaped stop 32.

When the cable lock 12 is in its locked position those cables 14 inserted within the slots 40 of the housing 16 are secured therein because the blocking shoulder 78 is of a size greater than the slot 40. Because the first and second opposed cover side walls 54, 56 of the cover 18 are now disposed over the enlarged portion 42 of the slots 40, the cable 14 may neither be inserted into nor withdrawn from the slots 40. As should now be readily apparent, simply by turning the key 82 the cover 18 will be caused to slide downwardly relatively to the housing 16 from the locked position illustrated in FIG. 2 to the unlocked position illustrated in FIG. 3. Once the unlocked position of FIG. 3 is achieved, enlarged portion 78 of the cables 14 can again be inserted into and withdrawn from the enlarged portion 42 of the slots 40.

FIGS. 1 and 2 illustrate that the cable lock 12 can be mounted to a fixture 88 such as a clothes rack using the U-bolt 46. In order to mount the cable lock 12, the U-bolt 46 is placed around the fixture 88 and its threaded ends 48 are inserted into the elongated holes 44 in the back housing wall 24. The U-bolt is then fastened and held into place by the nuts 50 which threadably engage the threaded ends 48 of the U-bolt 46.

Using the cable lock system of the present invention, the blocking shoulders of cables can be inserted into slots in a cable lock housing without having to remove the cover of the cable lock. Thus, it becomes less likely that one accessing the cable lock will lose the cable lock cover. Furthermore, using the cable lock system of the present invention cables may only be removed one at a time from the slots in the housing. Thus, the cable lock system of the present invention makes it more difficult for one unlocking the housing to quickly steal clothes secured by the cable lock system. Moreover, because a plurality of slots are provided, each being simultaneously accessible once the cover is in a position permitting access to the slots, any cable inserted into the slots may be quickly and easily removed. Finally, the cable lock system of the present invention, despite having these important advantages over the prior art structures, is not significantly more difficult or more expensive to build than the prior art structures.

I claim:

1. A cable lock for securing therein a cable with a shoulder thereon, the cable lock comprising:

a plate;

at least one opening in said plate;

said opening being dimensioned to allow passage of said cable and shoulder therethrough;

a cover;

a cover lock with a tumbler having a movable shaft operatively associated therewith, the shaft having a latch thereon and being movable relative to said cover to selectively place the latch in first and second positions;

means for mounting said cover to said plate for selective movement relative to said plate between (a) a first position in which passage of the shoulder through the opening is allowed, and (b) a second position in which passage of the shoulder through the opening is blocked by the cover, there being no means normally biasing the cover toward either of said first and second positions; and moving means on the plate and latch causing the latch to drive the cover from one of its first and second positions into the other of its first and second positions as an incident of the latch moving between its first and second positions.

2. The cable lock of claim 1 wherein said shaft is rotatable relative to said cover and said latch directly engages said plate for causing said selective movement of said cover, said latch moves the cover from tis first position into its second position as the latch is moved from tis first position into its second position and there are means on the cover lock for releasably locking the cover in its second position with the latch in its second position.

3. The cable lock of claim 1 in combination with a cable having a diameter and a shoulder defining an effective diameter larger than the diameter of the cable.

4. The cable lock of claim 1 wherein said opening is a slot having an enlarged portion of a size sufficient to receive the shoulder upon lengthwise insertion of the cable.

5. The cable lock of claim 1 wherein said means for mounting said cover to said plate includes means for selectively allowing said cover to be removed from said plate to be entirely separable thereof.

6. The cable lock of claim 1 wherein said plate is elongate and has a plurality of openings such as the first claimed opening and said cover is movable lengthwise relative to the plate between its first and second positions.

7. A cable lock for securing a cable having a blocking shoulder adjacent one end, the cable lock comprising:

an elongated housing:

at least one slot in said housing of a size sufficient to slidably receive said cable, said slot having an enlarged portion therein of a size sufficient to permit the lengthwise passage of the blocking shoulder therethrough;

a cover having spaced walls;

cooperating means on the cover and housing for guiding relative movement of the housing and cover lengthwise of the housing selectively between a first relative position (a) permitting lengthwise passage of said blocking shoulder through said enlarged portion, and (b) a second relative position preventing the lengthwise passage of said blocking shoulder through said enlarged portion, there being no means biasing the cover toward either of said first and second positions;

a tumbler having a rotatable shaft operatively associated therewith, the shaft being rotatable independent of the cover; and a latch having a first end attached to said rotatable shaft and a second free end, the free end engaging said housing for slidably moving said cover between said first and second positions said cooperating means including said spaced cover walls engaging said housing and being slidable guidingly lengthwise relative to the housing; and moving means on the latch and housing causing the latch to drive the cover from its first position into its second position as an incident of the latch moving from its first position into its second position.

8. The cable lock of claim 7 wherein said moving means on the housing and latch simultaneously lock said cover in said second position as said latch assumes its second position and drives the cover into tis second positon.

9. The cable lock of claim 7 in combination with a cable having a diameter and a second end, said first end having a blocking shoulder of an effective diameter greater than the effective diameter of said slot but less than the effective diameter of said enlarged portion.

10. The cable lock of claim 7 further including:

means for fastening said housing to a fixture.

11. The cable lock of claim 10 wherein:

said means for fastenings aid housing to a fixture is a U-bolt having threaded ends secured within said housing by a pair of nuts threadably engaging said threaded ends.

12. The cable locking system comprising:

a plurality of cables each having a first and a second end;

a locking shoulder of a size larger than said cable proximate said second end;

a housing;

said housing having a plurality of angularly inclined slots having two spaced ends, said slots being of a width large enough to slidably receive said cables but smaller than said blocking shoulder, each of said slots further including an enlarged portion at one end of a size large enough to receive said blocking shoulder when inserted therein lengthwise of said cable, said slots being angularly inclined such that upon lengthwise insertion of said blocking shoulder into said enlarged portion said cable will be urged away from said enlarged portion and toward said opposed end by action of gravity;

a cover;

means for slidably engaging said cover to said housing, said cover being slidable between (a) a first position permitting lengthwise passage of said blocking shoulder through said enlarged portions and (b) a second position preventing the lengthwise passage of said blocking shoulder through said enlarged portion; and means for slidably moving said cover between said first and second position while simultaneously securing said cover in said second positon as said second position is assumed, said slidably engaging means comprising said cover and said housing having a to pan a bottom, the top of said cover having a securing tongue thereon, the top of said housing having a receiving flange thereon, said securing tongue slidably engaging said receiving flange, said cover having a securing hook thereon proximate the bottom of said cover, said housing having a receiving slit in its bottom, said securing hook slidably engaging said receiving slit.

13. A cable locking system comprising:

a plurality of cables each having a first and a second end;

a blocking shoulder of a size larger than said cable proximate said second end;

a housing;

said housing having a plurality of angularly inclined slots having two opposed ends, said slots being of a width large enough to slidably receive said cables but smaller than said blocking shoulder, each of said slots further including an enlarged portion at one end of a size large enough to insertable receive said blocking shoulder when inserted therein lengthwise to said cable, said slots being angularly inclined such that said upon lengthwise insertion of said blocking shoulder into said enlarge portion said cable will be urged away from said enlarged portion and toward said opposed end by action of gravity;

a cover;

means for slidably engaging said cover to said housing, said cover being slidable between (a) a first position permitting lengthwise passage of said blocking shoulder through said enlarged portions and (b) a second position preventing the lengthwise passage of said blocking shoulder through said enlarged portion, there being no means biasing the cover toward either of said first and second positions;

a tumbler having a rotatable shaft operatively associated with the tumbler, the shaft being rotatable independent of the cover;

a latch having a first end attached to said rotatable shaft and a second free end, the free end engaging said housing for slidably moving said cover between said first and second positions while simultaneously securing said cover in said second position as said second position is assumed; and means for mounting said housing to a fixture in a first orientation whereby said cover is urged toward said first position by force of gravity.

14. The cable locking system of claim 13 wherein: p1 said means for fastening said housing to a fixture is a U-bolt having threaded ends secured within said housing by a pair of nuts threadably engaging said threaded ends.

15. The cable lock of claim 1 in combination with a fixture for suspending the cable lock and means for mounting the cable lock to the fixture in a first orientation whereby said cover is moved into its first position solely by force of gravity so that the cover is normally in its first positon.

* * * * *

UNITED STATES PATENT AND TRADEMARK OFFICE

CERTIFICATE OF CORRECTION

PATENT NO. : 5,154,072

DATED : October 13, 1992

INVENTOR(S) : Roger J. Leyden

It is certified that error appears in the above-identified patent and that said Letters Patent is hereby corrected as shown below:

Column 8, line 8, delete "to pan a bottom" and insert -- top and a bottom --.

Signed and Sealed this

Fifth Day of October, 1993

*Attest:*

*Attesting Officer*

BRUCE LEHMAN

*Commissioner of Patents and Trademarks*